United States Patent [19]

Adachi

[11] 4,085,647

[45] Apr. 25, 1978

[54] ELECTRONIC MUSICAL INSTRUMENT

[75] Inventor: Takeshi Adachi, Hamamatsu, Japan

[73] Assignee: Nippon Gakki Seizo Kabushiki Kaisha, Japan

[21] Appl. No.: 770,717

[22] Filed: Feb. 22, 1977

[30] Foreign Application Priority Data

Feb. 27, 1976 Japan ..... 51-21329

[51] Int. Cl.[2] ..... G10H 1/02

[52] U.S. Cl. ..... 84/1.24; 84/1.01; 84/1.26; 84/DIG. 7

[58] Field of Search ..... 84/1.01, 1.24, 1.26, 84/DIG. 7, DIG. 8, DIG. 12

[56] References Cited

U.S. PATENT DOCUMENTS

| | | | |
|---|---|---|---|
| 3,902,392 | 9/1975 | Nagahama | 84/1.01 |
| 3,960,044 | 6/1976 | Nagai et al. | 84/1.01 |

*Primary Examiner*—Edith S. Jackmon

*Attorney, Agent, or Firm*—Ladas, Parry, Von Gehr, Goldsmith & Deschamps

[57] ABSTRACT

An electronic musical instrument capable of controlling tone pitch, tone color, volume etc. of a musical tone by a sliding operation to conduct such on effect as portamento. The instrument according to the invention can produce a control signal proportional to a sliding distance on a portamento playing actuator regardless of an initially touched position on the actuator. For producing such control signal, an output voltage from a portamento playing actuator corresponding to a finger touch position is applied to a positive input of a calculator whereas a voltage obtained by sampling and holding an output voltage corresponding to the initial touch position is applied to a negative input of the calculator. Difference between the two voltages is outputted as a control voltage from the calculator and this control voltage is utilized for controlling VCO, VCF or VCA thereby to control the tone pitch, tone color, volume etc. of a musical tone.

4 Claims, 4 Drawing Figures

ELECTRONIC MUSICAL INSTRUMENT

BACKGROUND OF THE INVENTION

This invention relates to an electronic musical instrument and, more particularly, to an improved electronic musical instrument capable of obtaining a performance effect such as a portamento by a sliding operation.

A portamento device in the conventional electronic musical instrument serves, as shown in FIG. 1, to control an oscillating frequency of a voltage-controlled type oscillator (VCO) 2 by a voltage Vp corresponding to the position P on a resistor at which a portamento playing actuator 1 is touched. Therefore, the frequency of the portamento is unitarily determined according to the position P thus touched. Accordingly, in case a portamento performance is conducted with a desired frequency, a player must accurately touch the position P corresponding to the desired frequency at the actuator 1. However, it was very difficult to touch accurately the desired position of the actuator 1 during the performance on a keyboard.

SUMMARY OF THE INVENTION

The electronic musical instrument constructed according to this invention is adapted to produce a control voltage determined and variable in accordance with a distance covered by a sliding movement of a player's finger on an actuator using a sliding type performance actuator such as a portamento playing actuator. The voltage is determined regardless of an initially touched position on the actuator. Thus, a continuous control of pitch, tone-color, volume, etc. is effected by continuously moving the finger on the actuator. Accordingly, the frequency accurately starts to slide from the fundamental frequency of a musical tone during performance whatever position is initially touched on the portamento playing actuator. Thus, the device according to the invention greatly facilitates the portamento performance.

It is one object of this invention to provide an electronic musical instrument capable of eliminating the aforementioned disadvantages of the conventional instrument and of providing an easy portamento playing. and of providing an easy portamento playing.

It is another object of this invention to provide an electronic musical instrument capable of providing a portamento effect in plural tones with a constant mutual frequency relation.

It is another object of this invention to provide an electronic musical instrument capable of providing an easy portamento playing even if a portamento playing actuator is depressed from any position.

Other objects and feature of the invention will become apparent from the description made hereinbelow with reference to the accompanying drawings.

DESCRIPTION OF THE PREFERRED EMBODIMENTS

Figure 1:
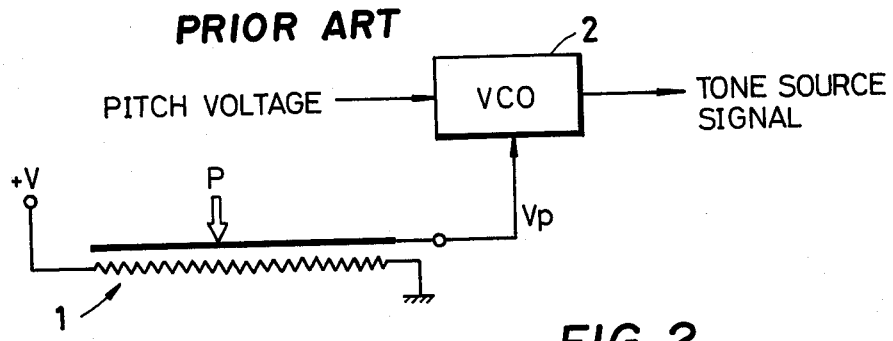
FIG. 1 PRIOR ART
FIG. 1 is a block diagram showing one example of the conventional portamento device.
Figure 2:
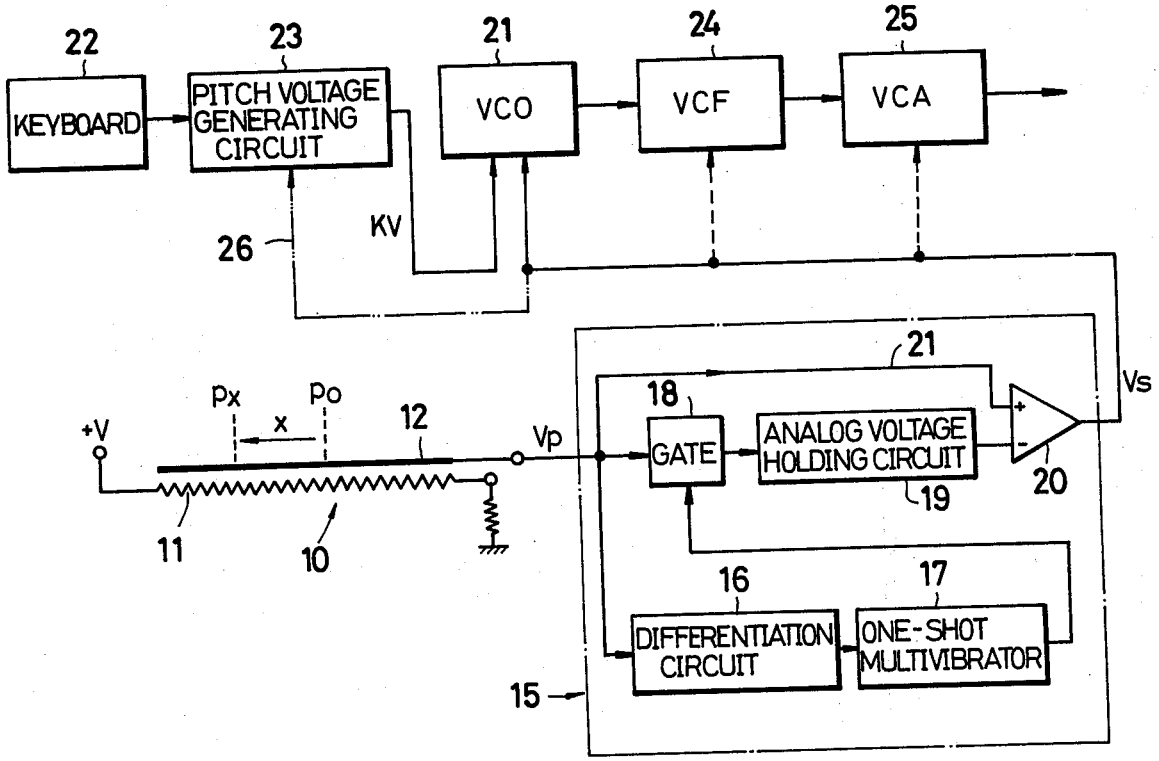
FIG. 2 is a block diagram showing one preferred embodiment of the electronic musical instrument according to this invention.

Referring first to FIG. 2, which shows one preferred embodiment of the electronic musical instrument according to this invention, a portamento playing actuator 10 has a resistor 11 and a conductor 12. If a portion of the conductor 12 is brought into contact with the resistor 11 upon depression of the conductor by the player's finger, the actuator 10 produces a voltage Vp corresponding to the contacted position.

Figure 3:
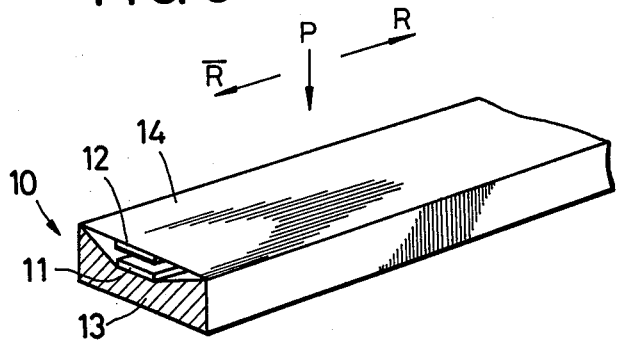
FIG. 3 is a structural explanatory view showing one example of a portamento playing actuator used for the instrument of this invention.

FIG. 3 shows a concrete structure of the actuator 10. This actuator 10 has a substrate or base plate 13 formed with a longitudinal groove therein, an elongated resistor 11 fixed to the bottom of the groove of the base plate 13, a flexible sheet 14 covering over the groove of the plate 13, and a conductor 12 fixedly secured underneath the sheet 14 opposite to and spaced away from the resistor 11.

In operation of the actuator 10 thus constructed, if the flexible sheet 14 of the actuator 10 is depressed at any position in the direction as designated by an arrow P in FIG. 3, the conductor 12 is brought into contact with the resistor 11 at the depressed position of the actuator 10. When the player's finger is slid over the sheet 14 in the longitudinal direction rightwardly or leftwardly as designated by arrows R or $\bar{R}$ with the actuator 10 kept depressed, the contacting position of the conductor 12 with the resistor 11 is displaced to vary the value of the voltage Vp. For example, the voltage $V_p$ can be produced by the actuator 10 in a range from 4 volts at maximum to 0.125 volts at minimum.

The voltage $V_p$ thus produced by the actuator 10 is supplied to a control signal generating device 15, in which it is differentiated in a differentiation circuit 16.

The differentiated output of the differentiation circuit 16 is applied to a monostable or one-shot multivibrator 17, which is triggered by the rise of the differentiated output from the circuit 16 to produce an output of one pulse upon starting of generation of the voltage $V_p$, i.e. upon starting of depression or starting of operation of the actuator 10. The output pulse of the one-shot multivibrator 17 serves to control a gate circuit 18 so as to sample the voltage $V_p$ applied from the actuator 10 to cause an analog voltage holding circuit 19 consisting, e.g. of a condenser to hold the sampled voltage. Thus, the holding circuit 19 stored the voltage of the value corresponding to the sliding operation starting position or depression starting position of the actuator 10.

An operational amplifier 20 may for example be a differential amplifier or subtractor. A voltage $V_{po}$ corresponding to the actuation starting position stored in the holding circuit 19 is applied a negative input of the operational amplifier 20, and the voltage $V_p$ supplied from the actuator 10 via a line L is applied as a position detection voltage to a positve input of the amplifier 20 to cause the amplifier 20 to produce a control voltage Vs corresponding to the difference between the voltages $V_{po}$ and $V_p$. In the meanwhile, the voltage $V_p$ continuously varies in response to the finger sliding operation of the player on the actuator 10. For example, assume that the distance of the finger movement on the actuator 10 in the sliding operation is represented by $x$ and the operating or depressing position after the sliding operation is represented by $px$. Further, the value of the position detection voltage $V_p$ corresponding to the position $px$ to be supplied to the line L is represented by $V_{px}$, and the position detection voltage corresponding to the operation starting position *po* is represented by $V_{po}$. The output Vs of the amplifier 20 is $$Vs \propto (V_{px} - V_{po})$$

Since the distance *x* covered by the sliding operation is the difference between the operation starting position *po* and the present operating position *px*, the control voltage Vs produced from the control signal generating circuit 15 is $$Vs \propto x$$

This is proportional the distance *x*.

Accordingly, whatever position of the actuator 10 is touched, the control voltage Vs is zero at the initial depression of the actuator 10, i.e., at the starting of sliding operation on the actuator 10, and the control voltage Vs continuously increases in a positive direction or decreases in a negative direction as the sliding operation thereafter is conducted successively.

The control voltage Vs proportional to the sliding distance is applied to the control input of a voltage-controlled oscillator (VCO) 21.

A pitch voltage KV corresponding to the pitch of a key depressed in a keyboard 22 is applied to the control input of the voltage-controlled oscillator 21 via a pitch voltage generating circuit 23. Accordingly, the oscillating frequency of the oscillator 21 is controlled by the sum (KV + Vs) of the control voltage Vs and the pitch voltage KV.

The control voltage Vs is continuously varied from zero as the portamento playing operation is carried on, while the pitch voltage KV is maintained constant corresponding to the fundamental frequency of the depressed key in the keyboard 22. Accordingly, whatever position the sliding operation is started at on the actuator 10, the frequency variation will always start from the fundamental frequency of the normal tone and will then slide by the amount proportional to the sliding distance on the actuator 10. Thus, since a similar portamento effect can always be obtained by the sliding operation starting from any position of the actuator 10, the portamento performance can easily be carried out.

If the control voltage Vs is adapted to be applied to the control input of the voltage-controlled type filter (VCF) 24 as designated by a broken line arrow in FIG. 2 the cut-off frequency or Q of the filter 24 can be continuously varied by the sliding operation of the actuator. In the meanwhile, if the control voltage Vs is applied to the control input of a voltage-controlled amplifier (VCA) 25 as designated by a broken line arrow in FIG. 2, a gain can be continuously controlled by the sliding operation. Thus, a tone-color or volume can be varied by the sliding operation in such a manner that similarly varying control voltage can always be obtained in correspondence to the sliding distance on the actuator 10 by the sliding operation started from any position thereon. Therefore, there can easily be achieved a standardized sliding variation effect of tone-color and volume without any irregularity.

It is to be noted that the control voltage Vs may also be applied to the pitch voltage generating circuit 23 as designated by a two-dotted broken line 26 in FIG. 2 so that the pitch voltage KV generated from the pitch voltage generating circuit 23 may accordingly be modulated by the control voltage Vs.

Figure 4:
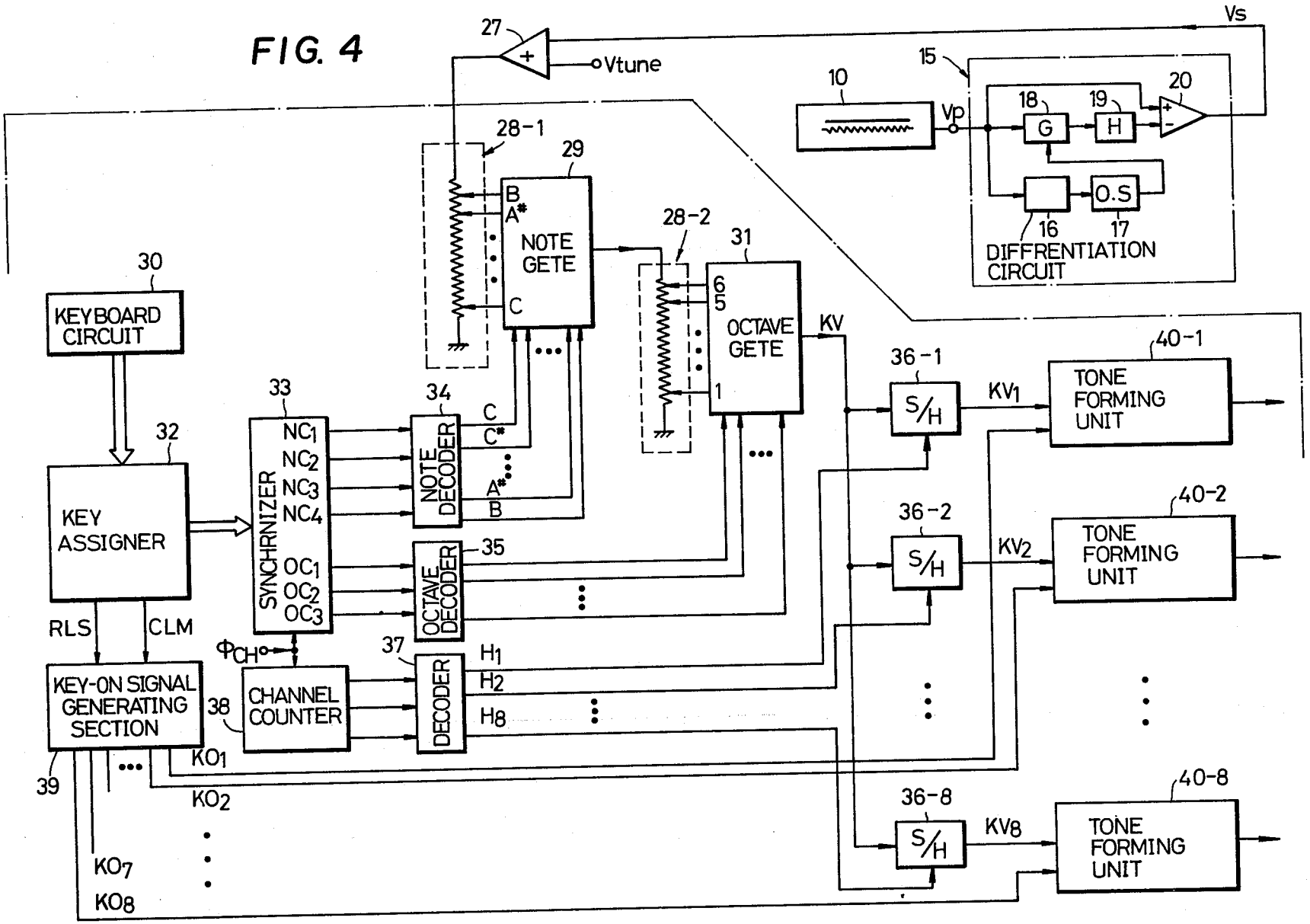
FIG. 4 is a block diagram showing another preferred embodiment of the instrument of this invention.

FIG. 4 shows another preferred embodiment of the electronic musical instrument of a plural tone type to which the principle of this invention is applied. In this circuit arrangement, a portamento playing actuator 10 and control signal generating device 15 are of the same construction and operation as those shown by the same reference numerals in FIG. 2.

The control voltage Vs proportional to the sliding distance *x* on the actuator 10 is applied to one input of an adder 27, and a set voltage Vtune is applied to the other input of the adder 27. Thus, the adder 27 produces a sum output signal of the control voltage Vs and the set voltage Vtune. This sum produced from this adder 27 is applied to a pitch voltage generating circuit 28-1, which is composed of a voltage divider for dividing the voltage applied from the adder 27 in a suitable ratio as desired to thus produce voltages corresponding to respective notes C, C#, . . . . A#, B. A note gate circuit 29 gates out voltages corresponding to respective notes of the depressed key generated in the pitch voltage generation circuit 28-1 and delivers this voltage to a pitch voltage generating circuit 28-2.

The pitch voltage generating circuit 28-2 is constructed to divide voltages applied from the note gate circuit 29 for each octave and to thus produce voltages corresponding to the pitches of the corresponding notes in each octave, e.g. from the first octave to the sixth octave. The voltage output from the pitch voltage generating circuit 28-2 is applied to an octave gate circuit 31.

The octave gate circuit 31 is constructed to gate out pitch voltages KV from the pitch voltage generating circuit 28-2 in accordance with the octave range to which the key depressed in the keyboard belongs.

When the control voltage Vs is zero, only the set voltage Vtune is applied to the pitch voltage generating circuit 28-1. Accordingly, a predetermined pitch voltage KV corresponding to the fundamental frequency of the depressed key is delivered out of the gate circuit 31 via the circuits 28-1, 29, and 28-2.

If the sliding operation or depression is conducted on the actuator 10, the control voltage Vs thus produced by the control voltage generating circuit 15 is continuously varied and accordingly the output voltage produced by the adder 27 will continuously change from the set voltage Vtune. Accordingly, if the sliding depression is initiated on any arbitrarily selected position on the actuator 10, the tone thus produced will continuously vary its frequency from the fundamental frequency and a portament effect is thereby effected. The keyboard circuit 30 has a plurality of key switches respectively interlocked with the keys in the keyboard and, upon detection of ON-OFF states of the respective key switches, supplies, information of the key switch which are ON to a key assigner 32.

The key assigner 32 produces a key code (binary information) representing the key switch corresponding to the depressed key based on the information of the key switch being ON, assigns a musical tone corresponding to the key switch to a predetermined channel and delivers out the key code corresponding to the depressed key assigned to each channel in a time-sharing manner. The key assigner 32 is adapted also to produce in time sharing a claim signal CLM representing that the key is depressed in the particular channel or a release signal RLS representing that the key has been released in the channel in synchronism with the delivery of the key code.

The key code thus produced consists of a combination of 4 bits of note code $NC_1$, $NC_2$, $NC_3$ and $NC_4$ representing the note of the key and 3 bits of octave code $OC_1$, $OC_2$ and $OC_3$ representing the octave range to which the depressed key belongs.

As the key assigner 32 one disclosed in the specification of U.S. Pat. No. 3882751 issued on May 13, 1975 may be employed.

The key codes thus delivered from the key assigner 32 upon depression of plural key, are sequentially applied to a synchronization circuit 33. The synchronization circuit 33 sequentially delivers the respective key codes to decoders and at a low speed in synchronism with a low channel clock pulse $\phi_{CH}$.

The note decoder 34 decodes the note code $NC_1$–$NC_4$. The decoded output signals are applied to the note gate circuit 29 as gate control signals for the corresponding note.

The octave decoder 35 decodes the octave code $OC_1$–$OC_3$. The decoded output signal are applied to the octave gate circuit 31 as control signals for the corresponding octave. If, for example, the key corresponding to the note C in the second octave is depressed, the note code $NC_4$–$NC_1$ is "1110" and the octave code $OC_3$–$OC_1$ is "001". The note gate circuit 29 will thereupon provide a voltage corresponding to the note C, while the octave gate circuit 31 will provide a pitch voltage KV corresponding to the note C in the second octave. The voltage KV is applied to a plurality of sample-hold circuits 36-1 to 36-8 and is held in one of the sample-hold circuits 36 to which any one of signals $H_1$ to $H_8$ is applied from a decoder 37 at the same timing. The sampling operation of the sample-hold circuits 36-1 to 36-8 corresponding to the respective channels (e.g. 8 channels) is controlled by the outputs $H_1$ to $H_8$ supplied from the decoder 37.

A channel counter 38 sequentially counts the low channel clock pulse $\phi_{CH}$ and produces a code output of 3-bits defining each of the the eight channels. Accordingly, the decoder 37 sequentially produces output $H_1$ to $H_8$ on 8 output lines thereof in synchronism with the low channel clock pulse $\phi_{CH}$. The outputs of the decoder 37 are applied to the sample-hold circuits 36-1 to 36-8 of the respective channels as channel gate control signals $H_1$ to $H_8$ to cause the sample-hold circuits to sample the pitch voltage supplied from the octave gate circuit 31 in the channel represented by the channel gate control signal.

The period of the low channel clock pulses $\phi_{CH}$ is determined by taking into account time constant by the gate circuits 29 and 31 and a condenser (not shown) provided for holding the pitch voltage in the sample-hold circuits 36. The condenser completes its charging in one period of the low channel clock pulses $\phi_{CH}$.

Since the state of each key switch is detected by a high rate clock in the keyboard circuit 30 and the key code corresponding to the depressed key is delivered at the same high clock rate in a time-sharing manner from the key assigner 32, the synchronization circuit 33 which receives the key code applied at a high clock rate is adapted to deliver out the key code at a low clock rate synchronous with the low channel clock pulse $\phi_{CH}$.

The key-on signal generating section 39 converts the claim signal CLM and the release signal RLS to static signal for each channel, produces key-on signals $KO_1$ to $KO_8$ representing that the key is depressed in the channel in which the claim signal CLM is present and applies these signals to tone forming units 40-1 to 40-8 in accordance with the respective channels.

The pitch voltage $KV_1$ to $KV_8$ stored in the sample-hold circuits 36-1 to 36-8 corresponding to the channels assigned by the key assigner 32 are applied to the tone forming units 40-1 to 40-8 for controlling a voltage-controlled type oscillator (not shown) which is adapted to oscillate a tone source signal corresponding to any of the pitch voltages $KV_1$ to $KV_8$. The key-on signals $KO_1$ to $KO_8$ are used in the tone forming units 40-1 to 40-8 for generating thereupon an amplitude envelope of the musical tone or an envelope of cut-off frequency variations of the filter.

The tone forming units 40-1 to 40-8 respectively have a voltage-controlled type oscillator (VCO), a voltage-controlled type filter (VCF), a voltage-controlled type amplifier (VCA), etc. and produce tone signals of the frequencies corresponding to the pitch voltages KV corresponding to the keys assigned in the channels to control the tone-color and/or volume thereof.

The pitch voltages $KV_1$ to $KV_8$ assigned to the respective tone forming units 40-1 to 40-8 have respectively different values corresponding to the different keys. However, in case the portamento playing actuator 10 is operated by the sliding movement of the player's finger, the respective pitch voltages $KV_1$ to $KV_8$ are uniformly and continuously varied in response to the control voltage Vs. Accordingly, the frequencies of the respective tones are uniformly deviated from the fundamental frequencies of the normal tones corresponding to the depressed keys. Accordingly, if the finger sliding operation is made on the portamento playing actuator 10 while a chord is being played, all the pitches of the respective tones forming the chord are deviated to a higher or lower side with a constant mutual frequency relation. Such portamento effect cannot be accomplished in the conventional portamento device.

It will be appreciated that in the embodiment shown in FIG. 4, the control voltage Vs produced by the control voltage generating circuit 15 need not necessarily be applied to the pitch voltage generating circuit 28-1 but may be applied to the respective tone forming units 40-1 to 40-8 to be mixed therein with the pitch voltages $KV_1$ to $KV_8$ so as to control the voltage-controlled oscillator (VCO). It will also be appreciated that as the control voltage Vs a digital signal may be used, if required.

It should be understood from the foregoing description that since the control voltage proportional to the sliding distance can be easily obtained regardless of depressing position on the portamento playing actuator, a portamento performance can be easily achieved. It should also be understood that since the respective tones are provided with portamento effects maintaining predetermined mutual frequency relation when plural keys are simultaneously depressed, a desirable portamento effect can be obtained in the electronic musical instrument.

What is claimed is:

1. An electronic musical instrument comprising:

actuator means actuated by a sliding operation for producing a voltage variable according to the actuated position thereof in each instant;

control signal generating means for producing a signal proportional to a sliding distance in said actuator means responsive to the output voltage of said actuator means; and control means for controlling a musical tone element by the output signal of said control signal generating means.

2. An electronic musical instrument as defined in claim 1 wherein said control signal generating means comprise:

sample-hold means for sample-holding an initial output voltage produced by said actuator means; and a calculator for calculating difference between the output voltage from said actuator means and the output voltage from said sample-hold means.

3. An electronic musical instrument as defined in claim 1 wherein said control means control a voltage-controlled oscillator, a voltage-controlled filter and voltage-controlled amplifier by said control signal.

4. An electronic musical instrument comprising:

actuator means actuated by a sliding operation for producing a voltage variable according to the actuated position thereof in each instant;

control signal generating means for producing a control voltage proportional to a sliding distance in said actuator means responsive to the output voltage of said actuator means; and control means for controlling the frequency of a tone by controlling the oscillating frequency of a voltage-controlled type oscillator in response to a pitch voltage corresponding to a depressed key and said control voltage;

whereby a portamento performance is made by the sliding operation of said actuator means.

* * * * *